US007954412B2

(12) United States Patent
Jansson

(10) Patent No.: US 7,954,412 B2
(45) Date of Patent: Jun. 7, 2011

(54) LAUNCH TUBE PROTECTIVE COVER

(75) Inventor: Åke Jansson, Eskilstuna (SE)

(73) Assignee: SAAB AB, Linköping (SE)

( * ) Notice: Subject to any disclaimer, the term of this patent is extended or adjusted under 35 U.S.C. 154(b) by 171 days.

(21) Appl. No.: 12/271,419

(22) Filed: Nov. 14, 2008

(65) Prior Publication Data

US 2010/0282055 A1 Nov. 11, 2010

(30) Foreign Application Priority Data

Nov. 14, 2007 (EP) ..... 07120704

(51) Int. Cl.
*F41F 3/077* (2006.01)

(52) U.S. Cl. ..... 89/1.817

(58) Field of Classification Search ..... 89/1.817, 89/30, 31

See application file for complete search history.

(56) References Cited

U.S. PATENT DOCUMENTS

| | | | | | |
|---|---|---|---|---|---|
| 3,279,319 | A | * | 10/1966 | Semonian et al. | 89/1.81 |
| 3,742,814 | A | * | 7/1973 | Kroh | 89/1.8 |
| 4,134,328 | A | * | 1/1979 | Asp et al. | 89/1.817 |
| 4,455,917 | A | * | 6/1984 | Shook | 89/1.817 |
| 4,498,368 | A | | 2/1985 | Doane | |
| 4,934,241 | A | * | 6/1990 | Piesik | 89/1.817 |
| 4,970,937 | A | * | 11/1990 | Ward | 89/1.817 |
| 5,162,605 | A | | 11/1992 | Piesik | |
| 5,375,503 | A | * | 12/1994 | Breugnot et al. | 89/1.817 |
| 6,123,005 | A | * | 9/2000 | Kuchta et al. | 89/1.817 |
| 6,142,055 | A | * | 11/2000 | Borgwarth et al. | 89/1.817 |
| 6,311,604 | B1 | * | 11/2001 | Foris et al. | 89/1.817 |
| 6,526,860 | B2 | * | 3/2003 | Facciano et al. | 89/1.801 |
| 6,752,060 | B1 | * | 6/2004 | Griffin | 89/1.817 |
| 2006/0096449 | A1 | | 5/2006 | Williams et al. | |
| 2006/0277812 | A1 | * | 12/2006 | Cole | 42/96 |

FOREIGN PATENT DOCUMENTS

| | | | |
|---|---|---|---|
| GB | 2074296 | A | 10/1981 |
| GB | 2218785 | A | 11/1989 |
| WO | WO-2006/096326 | A1 | 9/2006 |

OTHER PUBLICATIONS

European Search Report—Apr. 17, 2008.

* cited by examiner

*Primary Examiner* — Bret Hayes
(74) *Attorney, Agent, or Firm* — Venable LLP; Eric J. Franklin

(57) ABSTRACT

A launch tube protective cover for mounting to a launch tube including a projectile. The launch tube protective cover is arranged for protecting the interior of the launch tube from external environment. The launch tube protective cover includes a flexible rippable vapor barrier faced towards the projectile and circumferentially attached to the launch tube.

4 Claims, 2 Drawing Sheets

LAUNCH TUBE PROTECTIVE COVER

CROSS-REFERENCE TO RELATED APPLICATIONS

This application claims priority to European patent application 07120704.7 filed 14 Nov. 2007.

TECHNICAL FIELD

The present invention relates to a launch tube protective cover. The invention is related to antitank weapon systems, but is not limited to such systems.

BACKGROUND ART

A man-portable antitank weapon comprises a launch tube having an antitank projectile therein adapted for launching in a safe and quick manner by a user. The launch tube has a front and rear cover for protection of the interior of the launch tube and thereby protecting the projectile within it. Hitherto the user must remove the cover before firing the weapon. This is a time consuming handling, not desired in a combat situation.

SUMMARY OF THE INVENTION

Thus, the object of the present invention is to provide a launch tube cover for a weapon of the above-mentioned type, e.g. a man-portable antitank weapon, which is easy to handle and which can be fired safely and quickly without the need of manually removing the cover of the launch tube before firing the weapon. It is also an object to provide a launch tube cover which is water proof, which has properties withstanding vibrations, impacts and which is puncture proof etc. It is also important that the projectile trajectory will not be disturbed by loose flying parts of the launch protective cover during the launching sequence.

This has been solved by the launch tube protective cover being defined in the introduction.

The flexible properties of the flexible rippable vapour barrier make the launch tube protective cover resistant against vibration, impact etc. The water proof characteristic feature of the flexible rippable vapour barrier will at the same time protect the interior of the launch tube from water penetration. The projectile can be launched in one simple operation, wherein the nose of the projectile breaking away the flexible rippable vapour barrier from the perimeter of the launch tube by pressing the flexible rippable vapour barrier and the launch tube protective cover in a direction corresponding with the projectile launching direction.

Preferably, the launch tube protective cover further comprises a front protective plate attached to the flexible rippable vapour barrier by a central fitting.

Thereby the flexible rippable vapour barrier of the launch tube protective cover will be protected from unintentional punctures by twigs or other objects onto which the user carrying the weapon may strike during transportation. By means of the central fitting, such as a double-stick tape, joining the flexible rippable vapour barrier and the front protective plate, a free circumferential area defined between the perimeter of the launch tube and the outer edge of the central fitting will be achieved providing that the flexible rippable vapour barrier still can stretch, which is beneficially regarding the launch tube protective cover's properties withstanding vibrations, impacts etc. The flexible rippable vapour barrier will therefore not rupture in case of vibrations, impacts etc. However, the flexible rippable vapour barrier has such strength that the advancing nose of the fired projectile will rupture the flexible rippable vapour barrier from the perimeter of the launch tube along a circular line within said free circumferential area, preferably adjacent the perimeter of the launch tube.

Suitably, an interior projectile protective cover is arranged to the flexible rippable vapour barrier.

If the projectile's nose portion is provided with aerodynamic stabilization fins there may be a risk that the fins during the launch sequence will tear the flexible rippable vapour barrier apart and a risk of introducing trajectory disturbances to the launched projectile. By means of the interior projectile protective cover this risk is eliminated and therefore the launch tube protective cover will break away in one part from the launch tube by means of the projectile. No loose parts of the flexible rippable vapour barrier will occur during the launching disturbing the trajectory.

Preferably, the launch tube protective cover is arranged to the launch tube in such way that, when launching the projectile, the nose portion of the projectile will press the launch tube protective cover away from the launch tube by ripping a circumferential area of the flexible rippable vapour barrier.

Suitably, the launch tube protective cover is arranged hinged to the launch tube giving way to the projectile.

Thus, the launch tube protective cover will not hinder the projectile after it has pushed out the launch protective cover from the launch tube. The advancing projectile's nose will, during the launching sequence, push onto the inner surface of the launch protective cover. Immediately after being pushed out from the front end of the launch tube, the launch tube protective cover will be constrained by a hinge member, fastened to the launch tube protective cover and to the launch tube, and will swing away from the projectile trajectory, during the launching sequence. The projectile trajectory will thus not be disturbed.

BRIEF DESCRIPTION OF THE DRAWINGS

The present invention will now be described by means of preferred embodiments accompanied by drawings, of which FIG. 1 schematically illustrates a front end side view of a launch tube and an exploded view of a launch tube protective cover.

DETAILED DESCRIPTION

Hereinafter, embodiments of the present invention will be described in detail with reference to the drawings, wherein for the sake of clarity and understanding of the invention some details of no importance are deleted from the drawings.

Figure 1:
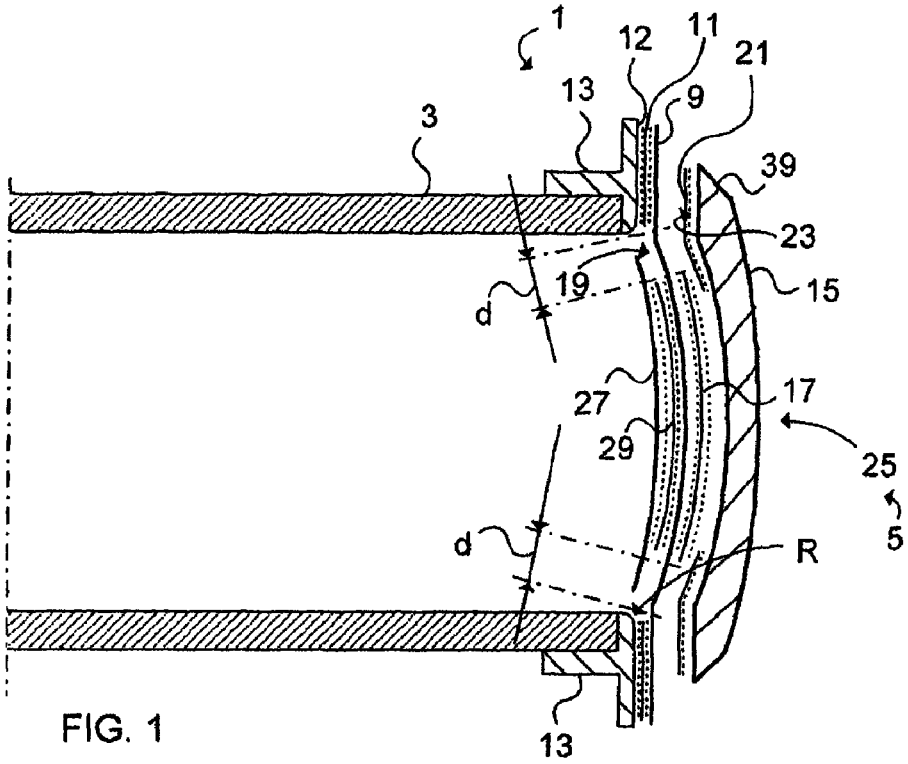

As shown in FIG. 1, a front end 1 of a launch tube 3 is adapted for mounting a launch tube protective cover 5. The launch tube 3 is a part of a portable one-shot antitank weapon. The launch tube 3 and a projectile 7 (see FIG. 2) are manufactured, pre-packed, and issued as a single unit of ammunition, with the launch tube 3 discarded after use.

The FIG. 1 shows schematically the launch protective cover 5 in an exploded view for the sake of clarity. A flexible rippable vapour barrier 9 made of foamed polyethylene comprising a convex area (projecting in a direction from the launch tube 3) is fastened by means of a ring-shaped double-stick tape 11 to a join ring 13, which is glued to the perimeter of the launch tube front end 1.

The launch tube protective cover 5 is to be mounted to the launch tube 3. The launch tube 3 comprises the projectile 7, which is supported within the launch tube 3. The launch tube protective cover 5 is arranged for protecting the interior of the launch tube 3 from external environment, such as water, shock wave, impact, punch, vibration influences etc. It is desirable that an user can transport the antitank weapon in a stressing environment. The launch tube protective cover 3 comprises the flexible rippable vapour barrier 9 faced towards the projectile's 7 nose and circumferentially attached to the launch tube 3 via the double-stick tape 11 and the join ring 13.

The launch tube protective cover 5 further comprises a front protective plate 15 attached to the flexible rippable vapour barrier 9 by a central fitting in the form of a central circular double-stick tape 17 with a radial extension such that a free area 19 (free of joining members) of the flexible rippable vapour barrier 9 will be left. In such way the resilient characteristic of the flexible rippable vapour barrier 9 will be maintained in a peripheral area (the free area 19), making the launch tube protective cover 5 resistant from above-mentioned external impact influences (the flexible rippable vapour barrier 9 is in such way arranged to not rip open due to impacts etc.) The distance d shown in FIG. 1 is 3-20 mm, preferably 10-15 mm. The front protective plate 15 is made of polyphenylene plastic (PPE) which is a hydrophobic material and having a high dimensional stability. The front protective plate 15 thus protects the flexible rippable vapour barrier 9 from outer environmental influences, such as cuts, punctures etc.

A glass fibre reinforced single-faced stick tape 21 is attached to the circumferential area 23 of the front protective plate 15 facing the launch tube 3. The central double-stick tape 17 is arranged overlapping the glass fibre reinforced single-faced stick tape 21. The front protective plate 15 is also provided with a convex portion 25 corresponding with the curvature of the flexible rippable vapour barrier 9. The glass fibre reinforced single-faced stick tape 21 will prevent the front protective plate 15 from being damaged and broken into pieces, which otherwise could rip the flexible rippable vapour barrier 9. The glass fibre reinforced single-faced stick tape 21 will thus keep the front protective plate 15 in one piece during environmental treatment and during the launching sequence.

An interior projectile protective cover 27 made of rigid plastic is arranged to the flexible rippable vapour barrier 9 by means of a second double-stick tape 29 having a radial extension essentially corresponding with the extension of the central double-stick tape 17 binding the flexible rippable vapour barrier 9 with the front protective plate 15. Both tapes 17, 29 are circular formed. The interior projectile protective cover 27 has a radial extension slightly greater than the extension of the second double-stick tape 29. The interior projectile protective cover 27 will eliminate the risk that fins 31 of the projectile 7 during the launch sequence will tear the flexible rippable vapour barrier 9 apart into loose flying objects introducing trajectory disturbances to the launched projectile 7.

A radius R is provided at the join ring's 13 inner flange for eliminating the risk that the join ring 13 will rupture the flexible rippable vapour barrier 9. The join ring 13 has a contact surface 12 for fastening the ring-shaped double-stick tape 11. The stick tapes are illustrated schematically with dotted lines, which correspond with the adhesive layers of the tapes.

Figure 2:
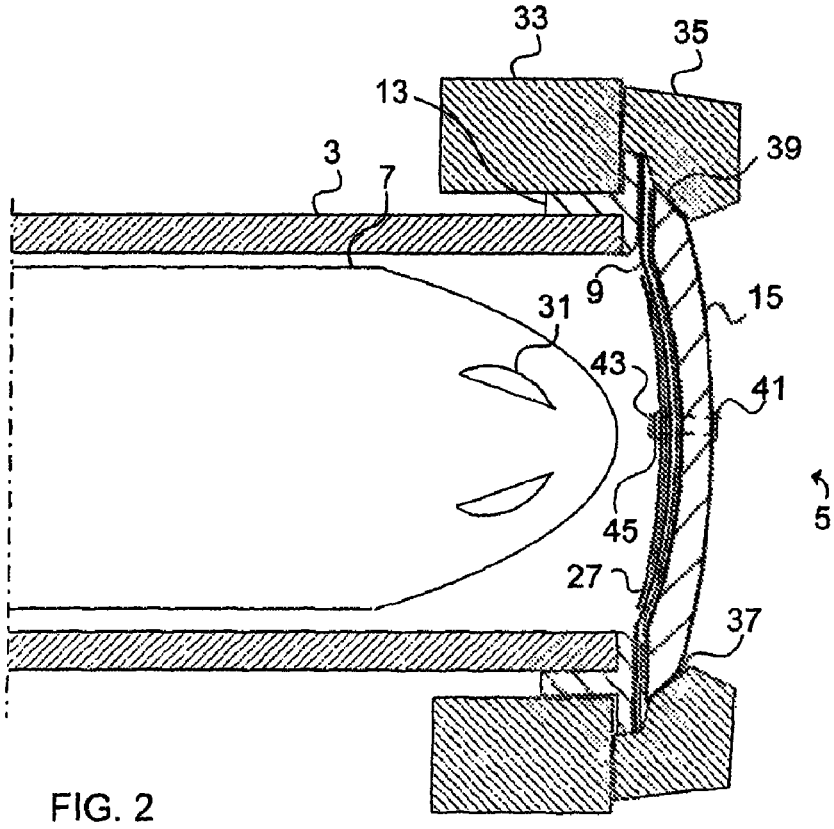
FIG. 2 schematically illustrates the launch tube protective cover in FIG. 1 mounted to the launch tube.

FIG. 2 schematically illustrates the launch tube protective cover 5 in FIG. 1 assembled and mounted to the launch tube 3. For axial damping is provided an axial damper 35 to the launch tube 3. The launch tube protective cover 5 is fastened to the join ring 13 via the ring-shaped double-stick tape 11. A radial damper 33 made of the same damping material as the axial damper 35 is glued to the later. The axial damper 35 comprises a beveled inner annular surface 37 arranged in close contact with a corresponding beveled annular surface 39 of the front protective plate 15 projecting in a direction form the launch tube 3. The both beveled surfaces 37, 39 are provided for the launching sequence as being explained further below with reference to the FIGS. 3*a*-3*d*. A rivet 41 is arranged centrally in the launch tube protective cover 5. The rivet's 41 head 43 located within the interior of the launch tube 3 is arranged sealed against the interior projectile protective cover 27 by means of a silicone sealing 45. The rivet 41 acts as an extra guarantee that the disc formed parts (the front protective plate 15, the interior projectile protective cover 27, the flexible rippable vapour barrier 9) will not fall apart.

Figure 3A:
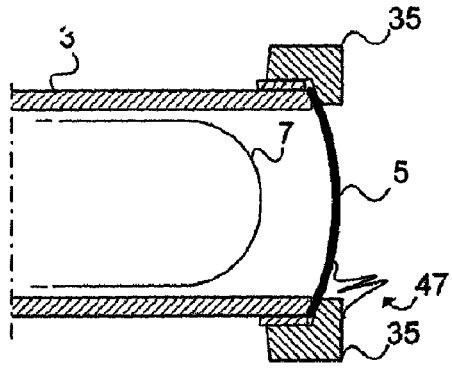
FIGS. 3*a*-3*d* schematically illustrate a launching sequence of a projectile removing a front protective cover.

FIGS. 3*a*-3*d* schematically illustrate a launching sequence of a projectile 7 being launched from the launch tube 3. The weapon operates on the principle of a "recoilless weapon" meaning that the forward inertia of the projectile 7 is balanced by the mass of propellant gases ejecting out the rear (not shown) of the launch tube 3. The launch tube 3 has also a back protective cover (not shown) designed in accordance with the launch tube protective cover 5 mounted at the front end of the launch tube 3. The flexible rippable vapour barrier of the back protective cover will also rupture (by means of the propellant gases) in a way similar to the flexible rippable vapour barrier 9 in the front, leaving no fragments which could disturb propellant gases and thus the trajectory. FIG. 3*a* shows the launch tube protective cover 5 fitted to the launch tube 3. The launch tube protective cover 5 is arranged hinged be means of a separate strip 47 fastened to the launch tube protective cover 5 and to the launch tube's 3 axial damper 35 giving way to the projectile 7 as being illustrated in FIG. 3*d*.

Figure 3B:
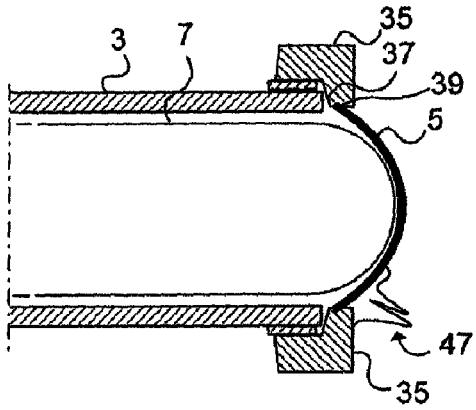
Figure 3C:
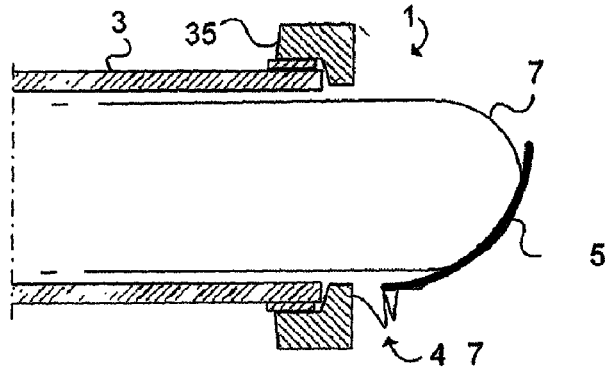

FIG. 3*b* illustrates when the nose of the projectile 7 starts to press the launch tube protective cover 5 out of the axial damper 35 upon the firing of the projectile 7. The beveled surfaces 37, 39 cooperate in a way so that the launch tube protective cover 5 easily will be pushed out from the launch tube 3. In FIG. 3*c* the projectile 7 has advanced further and has pushed the launch tube protective cover 5 completely out from it's fitting with the front end 1 of the launch tube 3. The hinge member, in the form of the strip 47, has such a length that the launch tube protective cover will be allowed to freely swing away from the projectile's 7 trajectory.

Figure 3D:
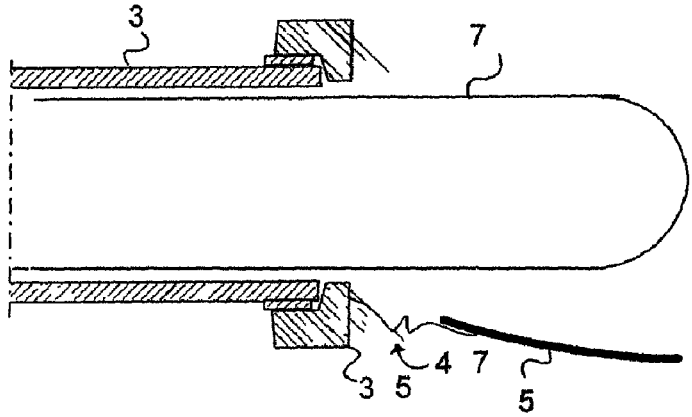

In FIG. 3*d* the launch tube protective cover 5 is completely out of the way and does not hinder the projectile 7 and does not disturb the trajectory of the projectile 7.

The invention claimed is:

1. A launch tube protective cover for mounting to a launch tube comprising a projectile, the launch tube protective cover comprising:

a flexible rippable vapor barrier faced towards a projectile and circumferentially attached to a launch tube, wherein the launch tube protective cover is arranged for protecting an interior of the launch tube from an external environment;

a front protective plate; and a central fitting configured to attach the front protective plate to the flexible rippable vapor barrier, such that there is a free circumferential area of the barrier between a perimeter of the launch tube and an outer edge of the central fitting.

2. The launch tube protective cover according to claim 1, further comprising:

an interior projectile protective cover arranged on the flexible rippable vapor barrier.

3. The launch tube protective cover according to claim 1, wherein the launch tube protective cover is arranged on the launch tube in such way that, when launching the projectile, the nose portion of the projectile will press the launch tube protective cover away from the launch tube by ripping a circumferential area of the flexible rippable vapor barrier.

4. The launch tube protective cover according to claim 3, further comprising:

hinges configured to attach the launch tube protective cover to the launch tube.

* * * * *